United States Patent [19]

Gannon

[11] Patent Number: 4,799,863

[45] Date of Patent: Jan. 24, 1989

[54] VACUUM FLOW DEVICE

[75] Inventor: Raymond Gannon, London, England

[73] Assignee: FGL Projects Limited, London, England

[21] Appl. No.: 193,203

[22] Filed: May 9, 1988

Related U.S. Application Data

[63] Continuation of Ser. No. 881,219, Jul. 2, 1986, abandoned.

[30] Foreign Application Priority Data

Jul. 3, 1985 [GB] United Kingdom ..... 8516838

[51] Int. Cl.[4] ..... F04B 23/08; F04F 5/44; A47L 5/16

[52] U.S. Cl. ..... 417/84; 417/80; 417/89; 417/158; 417/181; 417/196; 15/402; 15/409

[58] Field of Search ..... 417/76, 79, 80, 87, 417/89, 158, 181, 306, 196, 84; 15/409, 402; 119/83, 85–94

[56] References Cited

U.S. PATENT DOCUMENTS

| | | | |
|---|---|---|---|
| 974,286 | 11/1910 | Matchette et al. | 417/306 |
| 1,005,288 | 10/1911 | O'leary | 417/181 |
| 1,212,004 | 1/1917 | Berg | 417/181 |
| 1,661,002 | 2/1928 | McClymont et al. | 417/181 |
| 1,968,716 | 7/1934 | Smith | 417/181 |
| 2,074,666 | 3/1937 | Patalano | 417/187 X |
| 2,347,196 | 4/1944 | Hulman et al. | 417/76 X |
| 3,048,876 | 8/1962 | Kemnitz | 15/409 X |
| 3,574,885 | 4/1971 | Jones | 119/93 X |
| 3,668,736 | 6/1972 | Loscalzo | 15/402 |
| 3,778,864 | 12/1973 | Scherer | 417/159 X |
| 3,870,070 | 3/1975 | Kraft | 417/306 X |
| 3,943,329 | 3/1976 | Hlavac | 417/89 X |
| 4,361,418 | 11/1982 | Tscheppe | 417/54 |

FOREIGN PATENT DOCUMENTS

| | | | |
|---|---|---|---|
| 3020534 | 12/1981 | Fed. Rep. of Germany | 417/550 |
| 292939 | 1/1929 | United Kingdom | 119/85 |
| 1341558 | 12/1973 | United Kingdom | 417/550 |

*Primary Examiner*—Paul F. Neils
*Attorney, Agent, or Firm*—Bert J. Lewen; Henry Sternberg

[57] ABSTRACT

A vacuum device comprising a by-pass fan pump, a conduit connecting the inlet of the pump to a member in which pressure is to be reduced and a flow passage formation enabling a stream of air to enter the pump and to by-pass the member. In a preferred embodiment the inlet to the by-pass fan pump is connected to the outlet of a Venturi pump and the member is connected to the exhaust inlet of the Venturi pump. The device is directed particularly to the replacement of air by preserving gases in the packaging of foodstuffs.

10 Claims, 1 Drawing Sheet

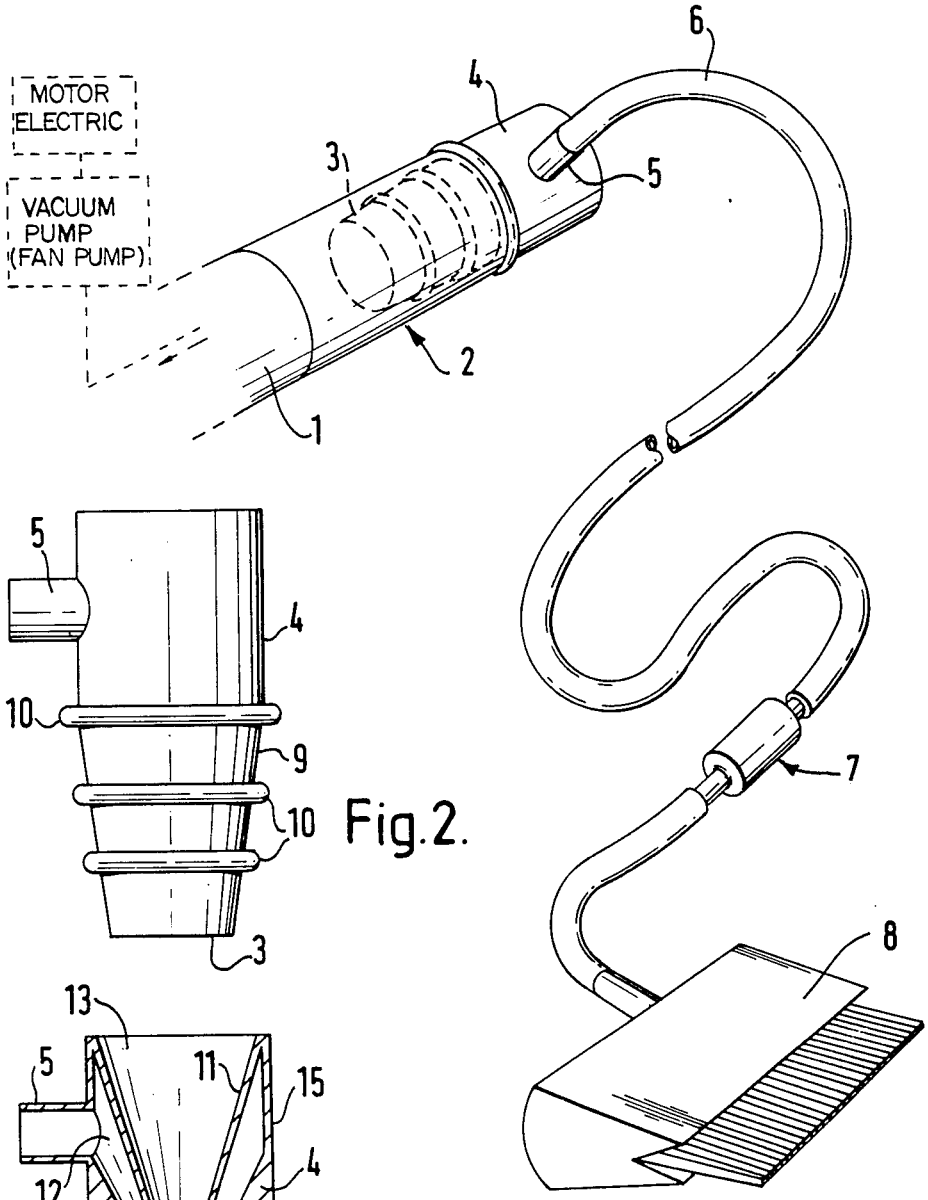
Fig.1.
Fig.2.
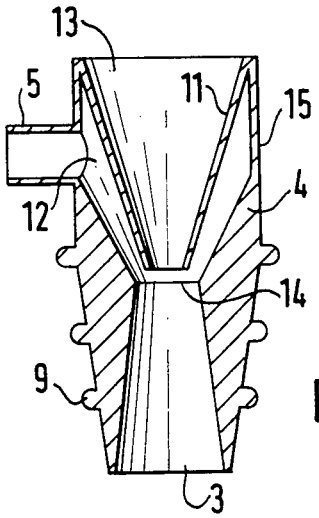
Fig.3.

VACUUM FLOW DEVICE

This is a continuation of application Ser. No. 881,219 filed on July 2, 1986 now abandoned.

This invention relates to an improved pump and more particularly to an improved pump of the by-pass fan variety.

By-pass fan pumps comprise generally a cylindrical casing incorporating a fan or impeller which is capable of drawing a large volume of air through the pump casing from a place where a vacuum is required. Pumps of this kind are used on a large scale for providing a source of vacuum for domestic vacuum cleaners. During normal use of a fan pump, air is drawn through a member where a vacuum is required, for example a cleaner head, and then through a relatively wide conduit which in the case of a domestic cleaner is frequently a flexible pipe having a diameter of about 35 mm. The stream of air then reaches the pump where it is drawn round and between the blades of the fan. When the pump is being used correctly air in substantial quantities continues to pass through the casing during the whole of the pumping operation.

Fan pumps are relatively simple to construct and inexpensive. Nevertheless they have important limitations if high vacua are required or if they are to be used under circumstances where the flow of air to the pump is either restricted severely or even prevented entirely. Such conditions occur for example when the tube connecting the pump is the member where the reduced pressure is required has a narrow bore for example about 10 mm which is the diameter of tubes used for the operation of many vacuum devices, or where the member is a container. Under these conditions fan pumps may achieve reductions in pressures of the order of 800–900 millibars. However, when these pressures have been reached and the flow of air through the pump has either fallen to a low level or even stopped entirely the electric motor powering the pump becomes overloaded and is liable to become damaged. We have discovered that if a fan pump is connected to a member which is likely to result in damage to the motor risks of damage can be reduced significantly and even eliminated entirely by permitting a controlled stream of air to by-pass the member and flow directly into the pump.

Accordingly this invention provides a vacuum device comprising a by-pass vacuum fan pump, a conduit connecting the inlet of the pump to a member in which a vacuum is to be created, and means enabling a stream of air entering the pump to by-pass the member.

Air entering the fan pump is split into two streams one of which passes through the member and the other passes directly through the pump. In general there are two types of members. The first comprises devices through which during normal operation air is drawn continuously for example, a grooming device such as a vacuum comb or a vacuum brush. The second comprises mainly various forms of containers for the packaging of goods in which the pumps are required to create a vacuum of some predetermined intensity depending on the nature of the goods to be preserved or protected. The suction requirements of different members varies depending on the function they are required to perform. Thus if the by-pass stream permits an excessive volume to pass through the fan pump the member will not be able to perform its function satisfactorily. On the other hand if the by-pass stream is too little the motor operating the pump is liable to become damaged. One method of controlling the by-pass stream is by means of a valve located either between the member and the pump or to the inlet of the pump for the by-pass stream. The correct balance between the two flows can be determined by simple trial and error. However, the use of a valve can be avoided provided that the conduits for the two streams are dimensioned correctly to ensure the required balance.

One preferred arrangement comprises connecting the outlet of a Venturi pump to the inlet of the fan pump, and connecting the exhaust inlet of the Venturi pump to the member. One type of Venturi pump operates by causing a jet of air moving at high speed from an orifice to discharge into an exhaust chamber where the jet intermingles with air already in the chamber and the mixture is then forced at high speed through an outlet, the mouth of which is in close juxtaposition to the orifice from which the jet of air enters the exhaust chamber. As a result of the intermingling of air present in the jet with the air in the exhaust chamber and the resultant removal of air from both sources the pressure in the exhaust chamber is reduced and provides a source of vacuum for the member. The use of a combination pump, i.e. a fan pump in conjunction with a Venturi pump in this way enables relatively large volumes of air to be exhausted rapidly and for pressures as low as 250–300 millibars to be attained without damage to the fan pump or the electric motor which powers the fan pump.

The present pumps can be constructed in different ways for different purposes. For example, an ordinary domestic vacuum cleaner whether of the upright or cylindrical variety can be converted readily into an invention pump by fitting the outlet of a Venturi pump onto the inlet of the vacuum cleaner. For most purposes however a specially constructed combination pump consisting of both a fan pump and a Venturi pump is generally more convenient to use.

This invention is illustrated but not restricted by the following drawings in which :

FIG. 1 is a view in perspective of one form of invention device.

FIG. 2 is a side view of member (4) shown in FIG. 1.

FIG. 3 is a side view taken in vertical section of the member shown in FIG. 2.

In FIG. 1 a wide bored flexible hose (1) one end of which is connected to a conventional vacuum cleaner (not shown) incorporating a by-pass fan and an electric motor for powering the fan. The other end is connected to a metal tube (2) to which different cleaning heads can be fixed when the cleaner is being used for its normal purposes. In the present case the tube is connected by a press fit with the outlet (3) of a Venturi pump (4). Pump (4) is provided with an exhaust inlet (5) which is connected to a heavy walled flexible tube (6) having an internal diameter of 10 mm to an inline filter trap (7). The latter is connected to a member consisting of a vacuum comb (8).

In FIGS. 2 and 3, a body of the Venturi pump (4) is provided with a tapered wall section (9) and a number of ribs (10) which are made of natural or synthetic rubber so as to enable wall (9) to form an air tight seal with the interior wall of tube (2). The presence of the ribs (10) and the taper on the wall (9) enables the pump (4) to form a satisfactory fit with vacuum cleaner tubes of different bores. Pump (4) is provided with a convergent member (11) which together with wall section (15) of the pump defines an exhaust chamber (12) which communicates with exhaust inlet (5).

In order to operate the device, pump (4) is connected to tube (2) by inserting tapered wall section (9) until the appropriate rib (10) is firmly engaged with the inner wall of tube (2). Tube (6) which is connected to vacuum comb (8) is then attached to inlet tube (5). When the vacuum cleaner is switched on air is drawn rapidly through fixed size inlet (13) of the pump and as the velocity of the air stream increases during its passage through the tapered section (11) of the pump it intermingles with air in exhaust chamber (12) at constriction (14) causing air to be drawn through comb (8) filter (7) and tube (6) into inlet (5).

It will be seen from the drawings that air entered tube (2) in its passage to the by-pass fan of the vacuum cleaner consists of two streams one of which enters inlet (5) of the Venturi pump and a second stream which passes directly through the Venturi pump via inlet (13) and exit (3) and thereby by-passes member (8). As a consequence the comb can be operated without overloading the motor of the by-pass fan.

Different forms of members where a vacuum is required can be used. For example the vacuum comb can be replaced by a vacuum brush in which conventional bristles are embedded in a hollow brush body having air inlet holes distributed among the roots of the bristles. In operation air is drawn between the bristles into the body of the brush through a hollow handle to which is connected a rubber tube having a bore of about 10 mm whilst the other end is connected to inlet (5) of the Venturi pump. The member can also comprise a milk collection appliance for applying a vacuum to a part of a human or animal body comprising a rigid or semi-rigid cup member having means connecting the interior thereof to a source of vacuum and a flexible diaphragm arranged to be resiliently fitted over a rim or a cup member and having an aperture therein, the arrangement being such that, in use the diaphragm is positioned so that a vacuum can be applied to the part of the body through the aperture.

The present pumps are of special use in the preservation or protection of a wide variety of goods, for example foodstuffs, medical samples, electrical and electronic equipment. For such purposes and particularly for foodstuffs vacua of the order of less than 20 millibars are generally required. These pressures are readily obtained with the present pumps when they are used in association with an auxiliary pump the choice of which will depend upon the nature of the goods to be preserved and the intensity of the vacua required. For example if freshness retention of food is to be achieved and the food is to be subjected to a vacuum in the presence of an oxygen containing gas the use of rotary oil pumps is better to be avoided in favour of a pump which does not use oil in its operation for example a diaphragm pump. The use of an auxiliary pump in conjunction with a combination pump enables containers to be evacuated and low pressure achieved rapidly and with equipment which is substantially less expensive and more compact than can be achieved with conventional pumps.

One method of using this arrangement of pumps is to connect them in parallel to a bag made of thermoplastic filmic material, for example polyethylene containing the goods and placing the bag in a container having rigid walls. The container is also connected to the pump arrangement and both the container and the bag is then exhausted separately after which a preserving gas is admitted into the bag whilst air is admitted into the container. The bag is then sealed. By appropriate choice of auxiliary pump pressures as low as 0.1 millibars can be achieved readily and by use of the pumps in this way the goods are not crushed during the exhaustion process and the efficiency of the process enables air contained in the goods to be rapidly replaced. This technique can also be used to considerable advantage in the packaging of foodstuffs in trays made of sheets of thermoplastic material and both bags and trays are preferably fitted with a valve to facilitate sealing when the atmosphere within the container has been replaced.

I claim:

1. Vacuum device arrangement comprising a gaseous flow system including a flexible suction intake conduit operatively connected to a vacuum fan pump, a Venturi pump element having a main fixed size flow inlet, a restrictive flow inlet, a Venturi arrangement, and a common outlet, the main flow inlet and the restrictive flow inlet being arranged for communicating at the Venturi arrangement for intermingling of flow from the main inlet with flow from the restrictive inlet for exiting through the outlet, and the outlet being releasably flow connected to the suction intake conduit, a member in which pressure is to be reduced, and a flexible restrictive flow conduit flow connecting the member with the restrictive flow inlet of the Venturi pump element, the main fixed size flow inlet having a selective main flow cross section and the restrictive flow inlet having a selective restrictive flow cross section which is smaller than the flow cross section of the main flow inlet, for controlled corresponding flow, into the main inlet from the exterior of the arrangement, and into the restrictive inlet through the restrictive flow conduit from the member in which pressure is to be reduced.

2. Arrangement of claim 1 wherein the exterior of the element adjacent the outlet is tapered inwardly in the direction toward the outlet and is provided with a plurality of local sealing contact means along its extent thereat for adjustably engaging the interior of the suction intake conduit for releasable connection of the outlet to such a suction intake conduit of selective interior size.

3. Arrangement of claim 1 wherein the suction intake conduit has an interior diameter of about 35 mm and the restrictive flow conduit has an interior diameter of about 10 mm.

4. Arrangement of claim 1 including an electric motor arranged for powering the vacuum fan pump.

5. Vacuum device arrangement comprising a gaseous flow system including a Venturi pump element in the form of a tubular element, and having a main fixed size flow inlet of selective main flow cross section, a restrictive flow inlet of selective restrictive flow cross section, an exhaust chamber, a common outlet, and a main flow passage extending through the element from the main flow inlet to the outlet and provided with a Venturi flow constriction formation therein intermediate the main flow inlet and the outlet, the main flow passage having an inlet portion extending from the main flow inlet to the constriction formation which converges in the direction towards the constriction formation, and further having an outlet portion extending from the construction formation to the outlet which diverges in the direction towards the outlet, the exhaust chamber being disposed in the element peripherally outwardly of the main flow passage, the restrictive flow inlet flow communicating with the exhaust chamber, and the exhaust chamber flow communicating with the main flow passage at the constriction formation to provide a flow intermingling Venturi arrangement thereat, the element being provided at the outlet with a releasable connection formation flow connecting the outlet releasably to a suction intake conduit connected to a vacuum fan pump, and the flow cross section of the restrictive flow inlet being smaller than the flow cross section of the main fixed size flow inlet for controlled corresponding flow, into the main inlet directly from the exterior of the arrangement, and into the restrictive inlet, the restrictive flow inlet being flow connected to a member in which pressure is to be reduced.

6. Arrangement of claim 5 including an electric motor arranged for powering the vacuum fan pump.

7. Arrangement of claim 5 wherein the exterior of the element adjacent the outlet is tapered inwardly in the direction toward the outlet and the connection formation includes a plurality of local sealing contact means thereat for adjustably engaging the interior of such a suction intake conduit for releasably flow connecting the outlet thereto.

8. Arrangement of claim 7 wherein the outlet is releasably adjustably connected to said suction intake conduit, and the restrictive flow inlet is operatively flow connected by a restrictive flow conduit to said member in which pressure is to be reduced.

9. Arrangement of claim 8 wherein the member is a grooming device.

10. Arrangement of claim 8 wherein the suction intake conduit and restrictive flow conduit are flexible conduits.

* * * * *